US007389817B2

(12) United States Patent
Almdahl et al.

(10) Patent No.: US 7,389,817 B2
(45) Date of Patent: Jun. 24, 2008

(54) RISER CONTROL DEVICE

(75) Inventors: Per Almdahl, Oslo (NO); Jeffrey Charles Edwards, Suffolk (GB)

(73) Assignee: Norsk Hydro ASA, Oslo (NO)

( * ) Notice: Subject to any disclaimer, the term of this patent is extended or adjusted under 35 U.S.C. 154(b) by 627 days.

(21) Appl. No.: 10/501,325

(22) PCT Filed: Jan. 15, 2003

(86) PCT No.: PCT/NO03/00011

§ 371 (c)(1),
(2), (4) Date: Nov. 9, 2004

(87) PCT Pub. No.: WO03/060288

PCT Pub. Date: Jul. 24, 2003

(65) Prior Publication Data

US 2005/0051339 A1 Mar. 10, 2005

(30) Foreign Application Priority Data

Jan. 16, 2002 (NO) ..... 20020233

(51) Int. Cl.
*E21B 29/12* (2006.01)

(52) U.S. Cl. ..... 166/361; 166/55; 166/363; 251/1.3

(58) Field of Classification Search ..... 166/361, 166/105.5, 351, 363, 364, 367, 297, 55, 55.1; 251/1.3

See application file for complete search history.

(56) References Cited

U.S. PATENT DOCUMENTS 1,839,394 A 1/1932 Inge
2,812,197 A 11/1957 Gibson
2,919,111 A * 12/1959 Nicolson ..... 166/352
2,969,838 A * 1/1961 Wilde ..... 166/55
3,684,008 A * 8/1972 Garrett ..... 166/55
3,720,260 A * 3/1973 Duck et al. ..... 166/336
3,870,098 A * 3/1975 Houston ..... 166/55.1
4,095,805 A 6/1978 Allen
4,215,749 A * 8/1980 Dare et al. ..... 166/361
4,240,503 A * 12/1980 Holt et al. ..... 166/55
4,313,496 A * 2/1982 Childs et al. ..... 166/55
4,323,117 A * 4/1982 Pierce ..... 166/55
4,347,898 A * 9/1982 Jones ..... 166/55
4,441,742 A * 4/1984 Owens, III ..... 285/18

(Continued)

FOREIGN PATENT DOCUMENTS

CA 2 088 794 8/1994

*Primary Examiner*—Thomas A Beach
(74) *Attorney, Agent, or Firm*—Wenderoth, Lind & Ponack, L.L.P.

(57) ABSTRACT

A riser control device, particularly designed to be used in connection with spool or horizontal production trees (12) for wells in sub-sea oil and gas installations. Within a housing (1,2) of the device is provided, in opposed direction, radially movable pair of rams (6) for isolating (sealing off) the well and simultaniously, in opposed direction a radially movable pair of shear blades (7) for cutting off an intervention string or the like. The rams (6) and blades (7) are driven by means of a vertically disposed actuator (8,9,23) integrated in the housing (1, 2). The actuator may be in the form of a hydralically driven annular piston (23)/annular chamber (29,30) device, which via piston rods (14) and translation beams (8) transforms the movement of the piston (23) to open or close the rams (6) and shear blades (7).

10 Claims, 6 Drawing Sheets

U.S. PATENT DOCUMENTS 4,508,313 A * 4/1985 Jones ..... 251/1.3
4,580,626 A * 4/1986 Jones ..... 166/55
4,987,956 A * 1/1991 Hansen et al. ..... 166/361
5,287,920 A * 2/1994 Terrell ..... 166/55
5,360,061 A * 11/1994 Womble ..... 166/55
5,400,857 A * 3/1995 Whitby et al. ..... 166/297
5,515,916 A * 5/1996 Haley ..... 166/55
6,244,336 B1 6/2001 Kachich
6,601,650 B2 * 8/2003 Sundararajan ..... 166/361

* cited by examiner

RISER CONTROL DEVICE

BACKGROUND OF THE INVENTION

The present invention relates to a riser control device, particularity designed to be used in connection with spool or horizontal production trees in sub-sea oil and gas installations.

The past decade has seen the use of sub-sea production systems become the method of choice for exploiting offshore oil and gas fields. The use of these systems offer significant advantages over traditional platform based methods in both economics and reservoir management terms. A significant change in sub-sea production systems occurred with the introduction of the spool or horizontal production tree. Enabling the use of large bore completions and subsequently multi-lateral wells, the introduction of this equipment has led to a considerable reduction in the number of wells required to fully exploit an offshore field. These systems also reduce capex and opex costs by enabling completion and intervention operations to be conducted via a traditional drilling riser and BOP (blow out preventer) as opposed to the dual skeletal riser normally associated with conventional sub-sea production trees.

Many of the fields developed with horizontal trees are now moving into the 2nd phase of production and consequently the intervention phase, i.e. extensive production logging programs followed by the diagnosed remedial operations such as re-perforating and water shutoff activity, the requirement for and difficulty of these operations is increased by the complexity of reservoirs both developed and planned. The very nature of the wells with long horizontal sections undulating through the producing section require the deployment of intervention tooling on compressively stiff coil tubing. The critical function when deploying equipment of this type in a sub-sea environment is the ability of the sub-sea LRP to cut the intervention string and isolate the well. Current well isolation devices utilized for this service are based upon established techniques utilized in down hole safety valves, with the primary cutting device being a ball valve and the primary sealing device being either a ball or flapper valve.

The use of a ball valve to provide a cutting function is unique to this type of application as cutting operations are normally conducted by BOP's which offer considerable advantages as the cutting efficiency is much greater and debris tolerance is significantly greater thereby providing improved sealing reliability.

A further major influence on intervention policy will be the ability to deploy the intervention system and conduct operations from a lightweight vessel.

In the formative era of the horizontal tree, it was envisaged that intervention operations would be conducted from a drilling rig via a marine riser/BOP and a large bore work over riser and LRP. However, the use of a conventional vessel involves cost implications not only with high opex but also with the increased complexity of mooring in and around production facilities and infrastructure. Many studies have been conducted to establish the economic and operational integrity of conducting interventions from a lightweight semi or mono hull vessel. The size of these vessels preclude the use of a marine riser and BOP stack, requiring the deployment of a sub surface lubricator system similar to that used on conventional tree interventions. Well control during these operations is achieved by a combination of barriers contained within the intervention system and the production tree. This enables full flexibility of well containment and even the complete retrieval of the intervention equipment, with the valves contained with in the vertical bore of the production tree providing well isolation.

However, when conducting similar operations on a horizontal tree with no vertical isolation capability (both tubing hanger and tree cap plugs removed to allow intervention string access), the only vertical isolation available is contained within the intervention system itself. Under normal circumstances this meets with accepted barrier philosophy but does preclude the ability to remove the intervention equipment or deploy a BOP for well kill or fishing operations. Several different concepts to improve the integrity of horizontal tree lightweight intervention operations that have been produced all allow the deployment of a drilling BOP during intervention operations, such as the use of a connector, shear ram and connector spool (the shear ram providing well isolation during intervention system running and pulling) or the deployment of a connector and spool with an integral internal valve which can be hydraulically closed enabling the intervention system to be retrieved and the BOP stack to be run. Both systems, however, add considerable weight to the intervention system, and consequently require a much larger vessel than those normally associated with lightweight intervention techniques. A further disadvantage is that the bending moment induced at the production tree and wellhead is substantially increased by the weight and length of the spool and additional connector, thereby precluding the use of this system in all but benign environments.

SUMMARY OF THE INVENTION

To avoid the above disadvantages of the above-mentioned BOP and ball valve solutions and to enable the advantages of the spool or horizontal production tree to be fully exploited, the present inventors have developed a riser control device according to the present invention, thereby enabling replication of the function of a conventional LRP providing both well control (safe isolation) and disconnect functions.

The original systems utilized in this role were developed from equipment introduced in the early eighties for exploration and appraisal activities which are generally of short duration and do not require the considerable number of inventory cycles experienced in a completion environment. As a consequence, the early systems utilized for this critical application did not provide the required availability, and thus considerable development effort was extended to produce a system to meet the availability and integrity requirements.

BRIEF DESCRIPTION OF THE DRAWINGS

The invention will be further described in the following by way of example and with reference to the drawings in which.

DETAILED DESCRIPTION OF THE INVENTION

Figure 1:
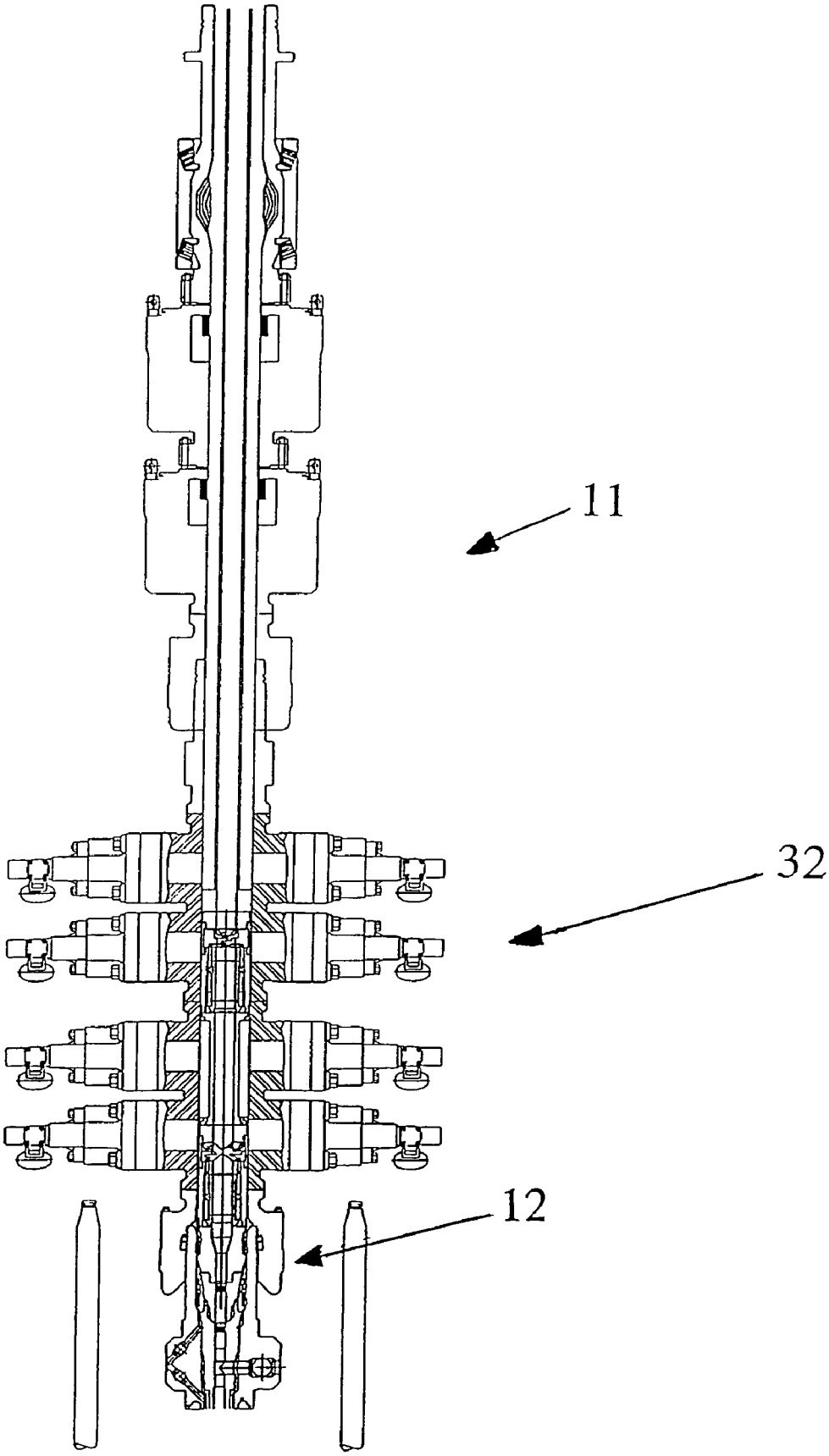
FIG. 1 shows a longitudinal (vertical) cross sectional view of a lower part of a riser with a horizontal production tree and a conventional BOP system.

Conventional BOP systems, as shown in FIG. 1, feature a pair of rams 32 located in horizontally opposed pockets located at 90 degree's to the vertical (well) bore or riser 11. To close, the rams move towards one another meeting at the center of the internal bore. Circa 40% of the ram length remains in each pocket to provide structural support resisting the pressure induced end load. Sealing integrity is achieved by a continuous elastomeric seal across the face of reach ram along the horizontal diameter of the ram and across the top o/d linking with the opposite horizontal leg, the sealing integrity being achieved by the contact of the elastomeric elements in the ram faces and the ram pocket. A major disadvantage of the system is that 50% of the total ram area is exposed to differential pressure when closed thus increasing effective sealing integrity. In subsurface applications (and most surface) the rams are hydraulically actuated by pistons mounted on the axis of the ram and pocket which are connected to the outer face of each ram via an actuator rod. The area of this rod is exposed to well bore pressure and subsequently generates an axial outward (opening) force upon the system, which necessitates the provision of some form of locking system (wedge-locks) to avoid inadvertent opening of the rams in the event of a hydraulic failure. As can be seen a BOP system design requires a considerable width to i/d ratio to function efficiently, normally in the region of 8 to 10. It is therefore obvious, despite the increased operational integrity provided by a BOP system, that the external envelope precludes the use of this technology.

Figure 2:
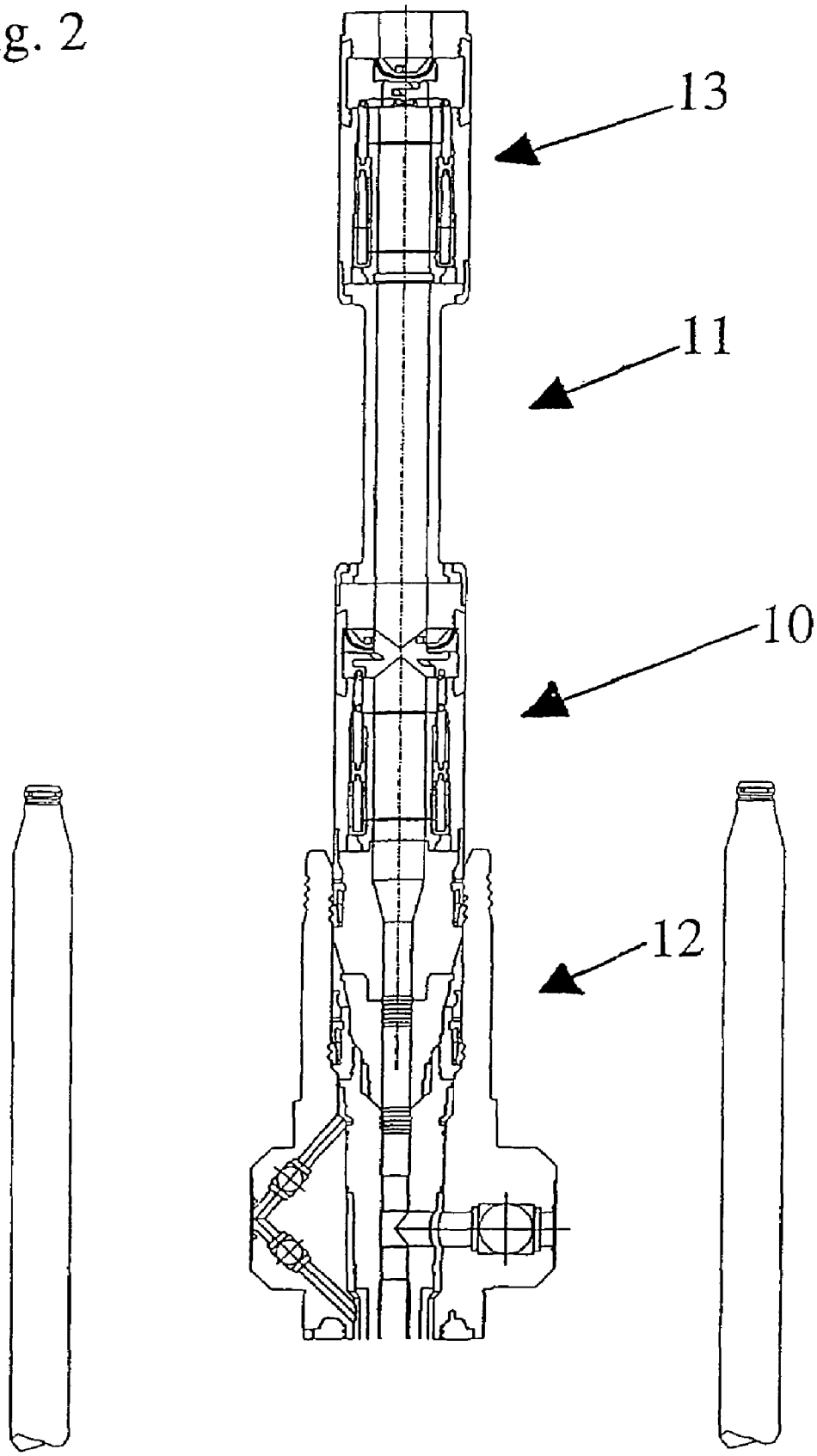
FIG. 2 shows a longitudinal (vertical) cross sectional view of the lower part of a riser with a horizontal production tree and above the tree provided a riser control device according to the invention.

As stated above, FIG. 2 shows a longitudinal (vertical) cross sectional view of the lower part of a riser 11 with a horizontal production tree 12, and above the tree is provided a riser control device 10 constructed according to the invention. As can be seen from FIG. 2, the riser control device 10 is connected directly to the tree at the end of the riser below a (conventional) closing valve 13.

Figure 3:
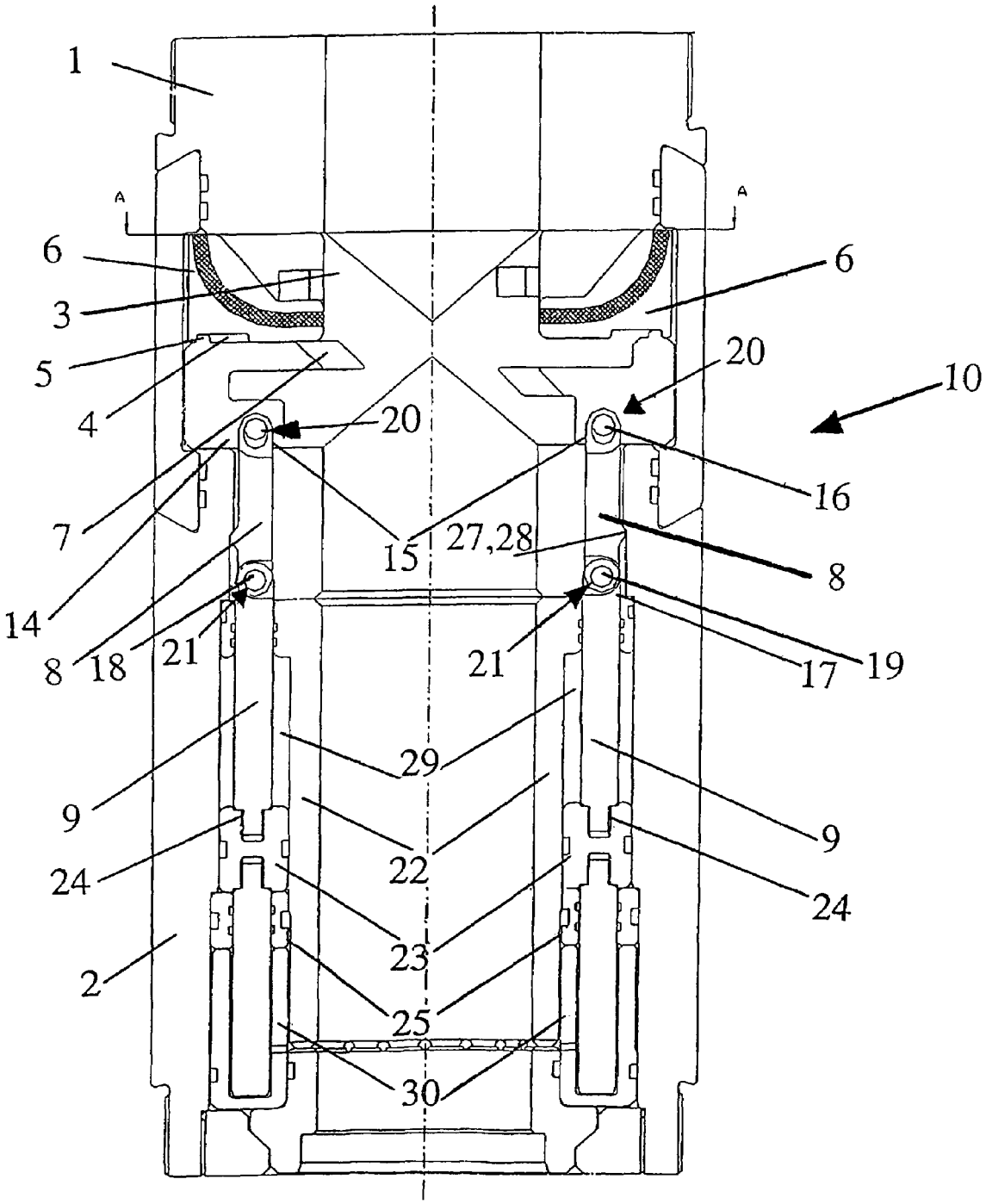
FIG. 3 shows on a larger scale a cross sectional view of the same riser control device showing a top sectional as well as a "side" sectional view (at another cross section angle).

Reference is now made to FIG. 3, which shows the riser control device 10 according to the invention in the normal operating (open) mode. The main body is made up of two sections, an upper housing 1 and a lower housing 2. The upper housing contains the rams 6 within cavities 3 which are formed between the interface of the upper and lower housing. Machined in the lower face of each ram is a tee shaped slot 4, which runs parallel to the axis of the ram. A mating spigot 5 is formed on the upper section of the shear blade 7 which fits into the slot 4 in the ram's lower face. This enables the blade to travel freely in relationship to the ram 6 for a predetermined linear distance. The distance of travel is determined by the length of the ram spigot (slot) and depth of the back plate attached to the ram. On the opposite face of the blade to the spigot, parallel the axis of the ram, a flange is formed with a center hole through the flange at 90 degrees to the ram and blade axis. The blade flange fits between two identical flanges 15 formed on the upper section of the translation beam 8 and is locked in position by inserting a retainer pin 16 into the bore of all three flanges. This effectively enables linear movement of the translation beam 8 to be transferred to the blade/ram assembly whilst enabling the vertical movement of the translation beam 8 to be absorbed as rotational component.

The lower end of the translation beam 8 is identical to the upper terminating in a dual flanged yoke 17 each with a center hole at 90 degrees to the main axis of the beam. These flanges fit over a corresponding flange 18 formed on the upper section of the piston rod 9 and are attached by the insertion of an identical retainer pin 19 to that utilized in the upper yoke. This flangeyoke assembly, although identical to the upper assembly, which allows the horizontal and vertical movement component to be transferred to a total horizontal movement, enables the vertical movement of the piston rod 9 to be split into horizontal and vertical components.

Therefore, the combination of the two rotational hinges 20, 21, at the opposite ends of the translation beam 8, enables the vertical movement of the piston rod 9 to be transferred to a total horizontal movement of the ram/bade assembly.

The amount of vertical travel required to obtain the required horizontal component to fully open and close the rams 6 is dependant on both the length of the translation beam 8 and the initial angular offset of the rotational hinges 20, 21. It should be noted that the longer the translation beam length, the less the vertical travel required to obtain the horizontal component to obtain full closure. A significant advantage of this method of operating a ram 6, as opposed to a conventional linear system, is that the travel of the ram is inverse to the vertical travel of the actuator therefore providing considerable mechanical advantage during the cutting and sealing section of the stoke resulting in improved cutting and sealing integrity.

In normal operations the actuation system for the ram/cutter 6,7 is operated hydraulically, but other forms of motive force can be utilized. The hydraulic actuation system is effectively a self contained unit which is assembled externally. This allows the system to be rapidly refurbished if required. The system consists of eight major components which can be defined as follows inner mandrel 22, piston rod 9, annular piston 23, balance piston 24, intermediate seal carrier 25, carrier retainer 26, mandrel retainer 27, and retainer lock ring 28.

Once assembled the actuator assembly is placed into the lower housing and locked insitu by the installation of the retainer lock ring into the internal thread of the lower housing 2.

The installation of the assembly effectively forms two independent hydraulic chambers within the assembly. The upper chamber 29 is formed between the lower face of the inner mandrel 22 and the upper face of the annular piston 23. The lower chamber 30 is formed between the lower face of the annular piston 23 and the upper face of the intermediate seal carrier 25. Hydraulic conduits located in the external wall of the lower housing 2 are through ported into the respective hydraulic chambers. In the upper chamber 29, the opening conduit acts as the opening chamber, and hydraulic pressure applied to the chamber 29 creates a differential force across the annular piston 23 creating a motive force urging the piston 23 to travel in the downwards direction.

The piston rods 9, which are attached to the annular piston 23 by means of a thread 24, consequently travel downwards pulling the lower joint of the translation beam with it. This movement of the translation beam is transferred into horizontal movement of the shear blade 7 and ram 6 assembly, thereby urging each one to the open position.

The lower chamber 30, which is fed by the hydraulic conduit acts as the closure system. When hydraulic pressure is applied via the conduit, the pressure acts on the lower face of the annular piston 23 so as to create a differential pressure that translates to a motive force urging the piston 23 and consequently the piston rods 9 and lowerjoint 21 of the translation beam 8 upwards. The vertical movement is translated by the upper and lower joints of the translation beam to a true horizontal component, therefore moving the blades and subsequently the rams to the closed position.

Figure 4:
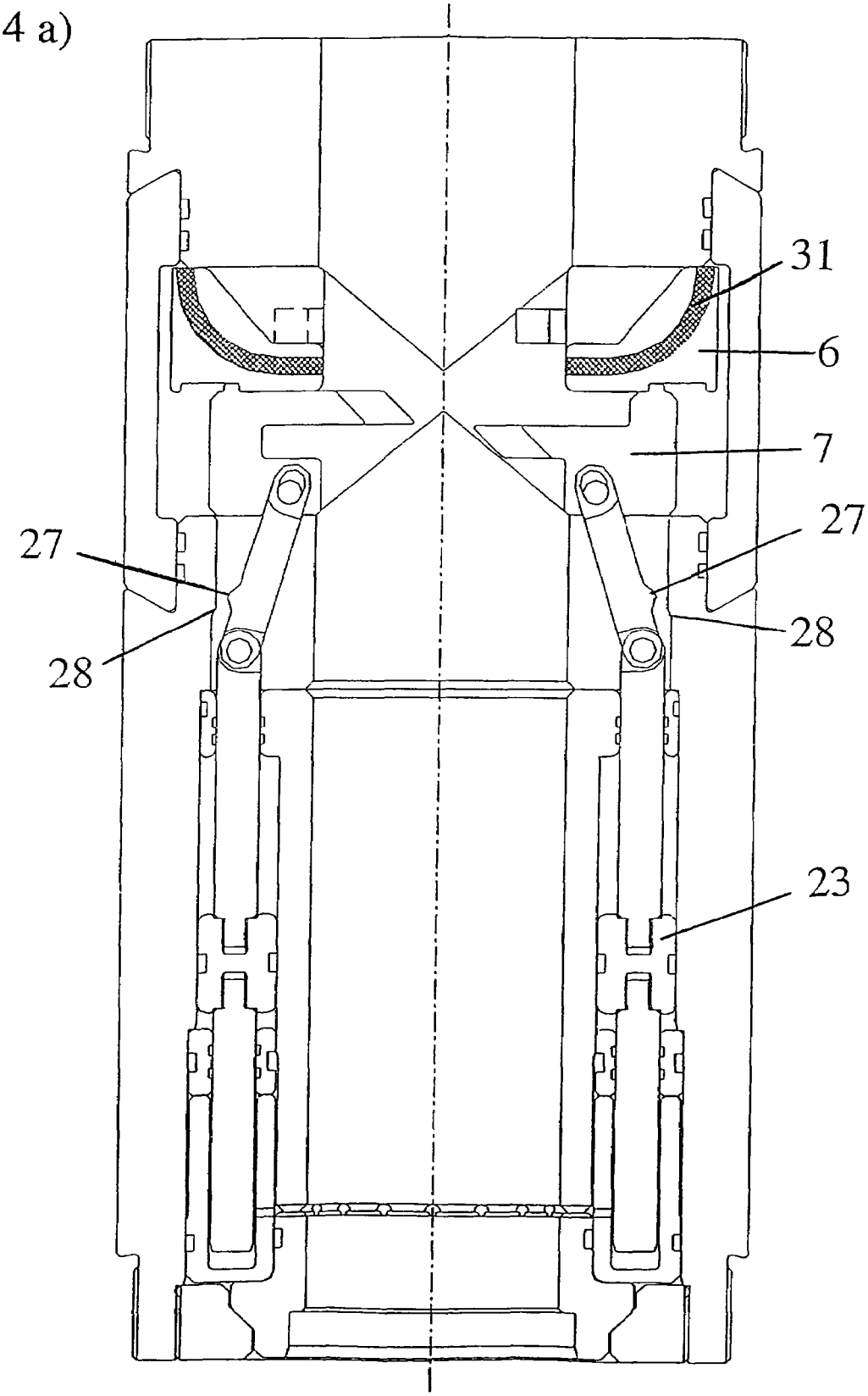
FIGS. 4*a*-4*c* show, in sequence, operation of the riser control device from an open to a closed position.
Figure 4:
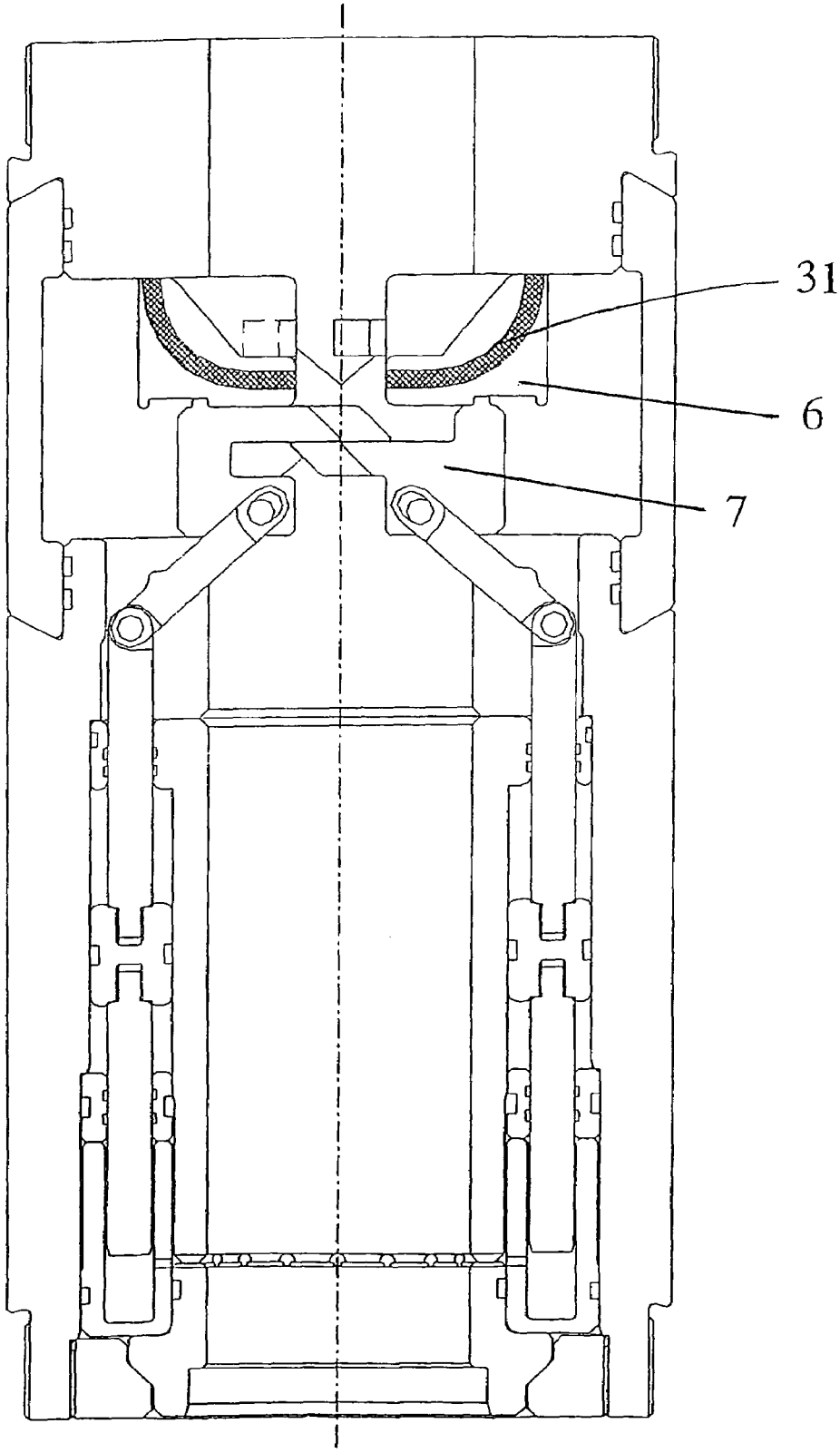
Figure 4:
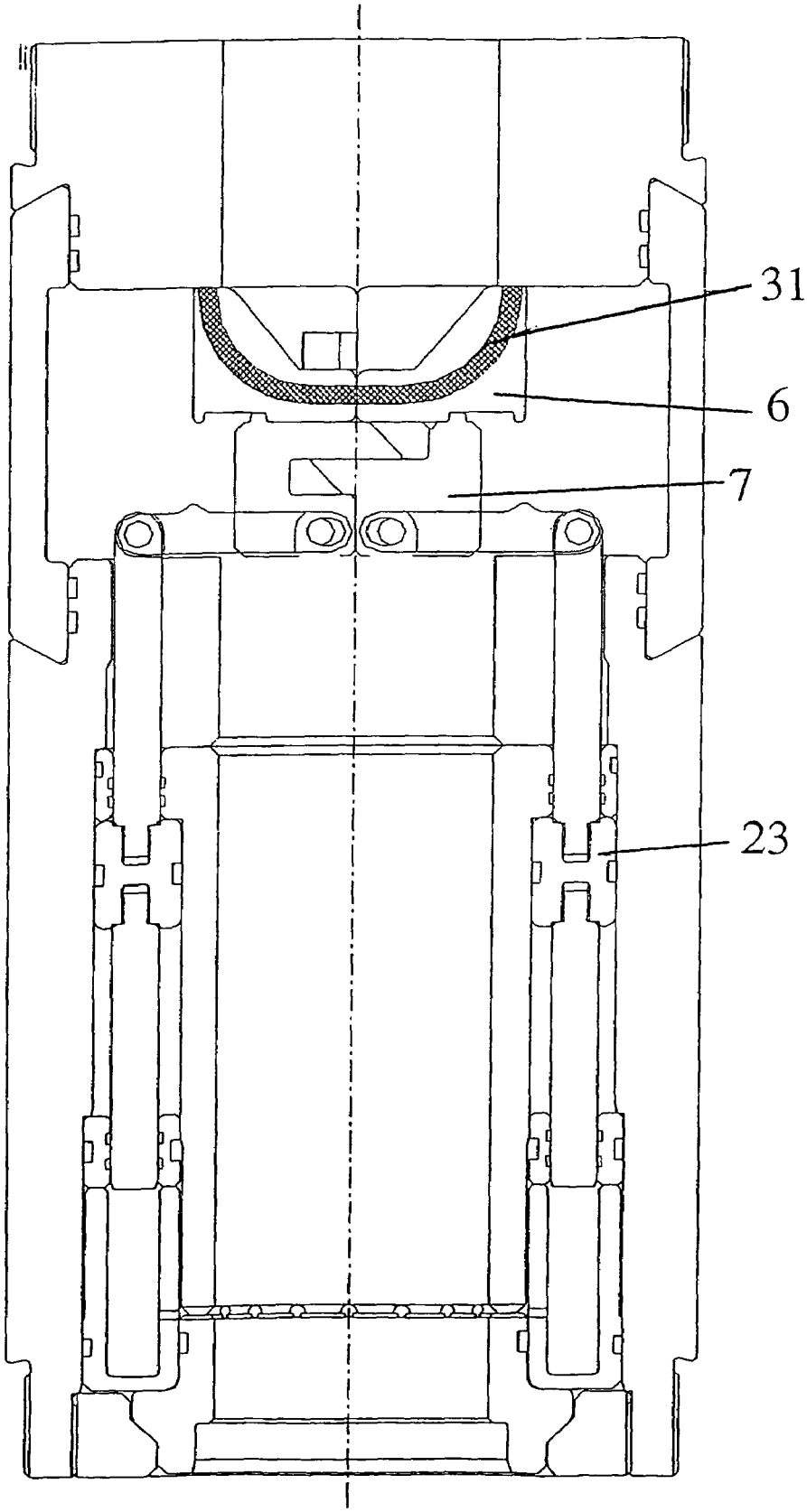

FIGS. 4(*a*)-(*c*) show the sequence of the riser control device from start to fully closed position. In FIG. 4(*a*) the closing operation is just initiated. Initial movement of the rams 6 is accomplished by means of spigots 27 provided on the translation beams 8. The beams 8 are pushed inwards as the spigots 27 engage against an inwardly elevating portion 28 on the housing 2, whereas at the same time the beams are moved upwards by the piston 23. FIG. 4(*b*) shows the control device in a position where the cutting knives 7 and rams 6 are in a mid-way cutting position, while FIG. 4(*c*) shows the rams 6 in a fully closed position where the resilient packing elements 31 are closing tightly against the remaining end of the production string (not shown) or the like.

The invention as defined in the claims is not limited to use in connection with cutting and sealing off a drill string or riser, but may as well be used as a conventional closing valve, without the cutting knives 7.

The invention claimed is:

1. A riser control device for use with spool or horizontal production trees for a well in sub-sea oil and gas installations, said device comprising:

a housing;

a pair of radially movable rams disposed within said housing, said rams being disposed in opposed relation for isolating the well;

a pair of radially movable shear blades disposed within said housing, said blades being disposed in opposed relation for cutting off an intervention string; and a vertically disposed actuator assembly, disposed within said housing, for simultaneously driving said rams and said blades, wherein said vertically disposed actuator assembly comprises a hydraulically driven annular piston disposed in an annular chamber, a piston rod connected to said piston, and a translation beam connected to said piston rod for transmitting movement of said piston to open or close said rams and blades.

2. The riser control device as claimed in claim 1, wherein said blades and said rams are connected such that radial movement of said blades can cause radial movement of said rams.

3. The riser control device as claimed in claim 2, wherein each of said rams has a slot in a lower face thereof, and each of said blades has a spigot on an upper section thereof, wherein said spigots are received in said slots, respectively, thereby forming the connection between said rams and blades.

4. The riser control device as claimed in claim 3, wherein each of said spigots can move in said respective slot without effecting movement of said blade.

5. The riser control device as claimed in claim 3, wherein each of said slots extends over a distance and is parallel to an axis of said respective ram, and each of said spigots is movable along the length of said respective slot without effecting movement of said respective blade.

6. A riser control device for use with spool or horizontal production trees for a well in sub-sea oil and gas installations said device comprising:

a housing;

a pair of radially movable rams disposed within said housing said rams being disposed in opposed relation for isolating the well;

a pair of radially movable shear blades disposed within said housing, said blades being disposed in opposed relation for cutting off an intervention string; and a vertically disposed actuator assembly disposed within said housing, for simultaneously driving said rams and said blades, wherein said vertically disposed actuator assembly comprises:

a first hydraulically driven annular piston disposed in a first annular chamber, a first piston rod connected to said first piston, and a first translation beam connected to said first piston rod for transmitting movement of said first piston; and a second hydraulically driven annular piston disposed in a second annular chamber, a second piston rod connected to said second piston, and a second translation beam connected to said second piston rod for transmitting movement of said second piston, wherein linear movement of said first and second piston rods is parallel to a longitudinal axis of said housing, and such movement is transmitted to said blades and rams to cause radial movement thereof that is perpendicular relative to the linear movement of said piston rods.

7. A riser control device for use with spool or horizontal production trees for a well in sub-sea oil and gas installations said device comprising:

a housing;

a pair of radially movable rams disposed within said housing, said rams being disposed in opposed relation for isolating the well;

a pair of radially movable shear blades disposed within said housing, said blades being disposed in opposed relation for cutting off an intervention string; and a vertically disposed actuator assembly disposed within said housing, for simultaneously driving said rams and said blades, wherein said housing comprises upper and lower interconnected housing sections, and said vertically disposed actuator assembly is disposed in said lower housing section.

8. A riser control device for use with spool or horizontal production trees for a well in sub-sea oil and gas installations said device comprising:

a housing;

a pair of radially movable rams disposed within said housing, said rams being disposed in opposed relation for isolating the well;

a pair of radially movable shear blades disposed within said housing, said blades being disposed in opposed relation for cutting off an intervention string; and a vertically disposed actuator assembly disposed within said housing, for simultaneously driving said rams and said blades, wherein said blades and said rams are connected such that radial movement of said blades can cause radial movement of said rams, and wherein each of said rams has a slot in a lower face thereof, and each of said blades has a spigot on an upper section thereof, wherein said spigots are received in said slots, respectively, thereby forming the connection between said rams and said blades.

9. The riser control device as claimed in claim 8, wherein said each of said spigots can move in said respective slot without effecting movement of said blade.

10. The riser control device as claimed in claim 8, wherein each of said slots extends over a distance parallel to an axis of said respective ram, and each of said spigots is movable along the length of said respective slot without effecting movement of said respective blade.

* * * * *